United States Patent [19]

Bailey et al.

[11] Patent Number: 4,647,490

[45] Date of Patent: Mar. 3, 1987

[54] COTTON PATTERNED FABRIC

[75] Inventors: Alan S. Bailey, Gonubie; Colin F. Clayson, East London, both of South Africa

[73] Assignee: Johnson & Johnson, New Brunswick, N.J.

[21] Appl. No.: 755,045

[22] Filed: Jul. 15, 1985

Related U.S. Application Data

[63] Continuation-in-part of Ser. No. 496,776, May 20, 1983, abandoned.

[51] Int. Cl.[4] ..... D04H 3/08; D04H 11/00

[52] U.S. Cl. ..... 428/131; 28/104; 28/105; 428/233

[58] Field of Search ..... 428/131, 233; 28/104, 28/105

[56] References Cited

U.S. PATENT DOCUMENTS

| | | | |
|---|---|---|---|
| 2,855,633 | 10/1958 | Harmon | 19/66 |
| 3,113,349 | 12/1963 | Nottebohm et al. | 19/161 |
| 3,214,819 | 11/1965 | Guerin | 28/72.2 |
| 3,365,752 | 1/1968 | Farell | 19/66 |
| 3,403,862 | 10/1968 | Dworjanyn | 239/566 |
| 3,620,903 | 11/1971 | Bonting et al. | 161/169 |
| 3,750,236 | 8/1973 | Kalwaiter | 19/161 |
| 3,769,659 | 11/1973 | Kalwaiter | 19/161 |
| 4,144,370 | 3/1979 | Boulton | 428/233 |
| 4,152,480 | 5/1979 | Adachi | 428/227 |

FOREIGN PATENT DOCUMENTS

| | | | |
|---|---|---|---|
| 419579 | 8/1974 | U.S.S.R. | 19/66 |
| 291575 | 9/1976 | U.S.S.R. | 19/66 |

*Primary Examiner*—John E. Kittle
*Assistant Examiner*—Patrick J. Ryan

[57] ABSTRACT

A web of gray cotton fibers is entangled by passing it under a series of low pressure liquid nozzles or jets which are oscillated in a direction transverse to the direction of travel of the web. The entangled web is then subjected to a cotton scouring step, and then dried, to produce a strong coherent nonwoven fabric that requires no resin binder and has a high capacity for water. Particular parameters of liquid pressure, frequency and amplitude of oscillation of the nozzles or jets and energy transferred from the jets to the fibers have to be maintained.

3 Claims, 10 Drawing Figures

COTTON PATTERNED FABRIC

REFERENCE TO RELATED APPLICATIONS

This application is a continuation-in-part of our copending application Ser. No. 496,776 filed May 20, 1983, now abandoned.

FIELD OF INVENTION

The invention relates to a process for the production of nonwoven fabrics made from gray cotton fibres, and to the novel nonwoven cotton fabrics that are made thereby.

BACKGROUND OF THE INVENTION

Nonwoven fabrics that are made by the fluid rearrangement of fibers have been in commercial use for some time. For instance, Kalwaites, in U.S. Pat. Nos. 2,862,251, 3,033,721, 3,931,436 and 3,769,659 and Griswold in U.S. Pat. Nos. 3,081,515 and 3,025,585, describe various processes for producing nonwoven fabrics by the fluid rearrangement of a fibrous web. However, resin binder has to be added after the fluid rearrangment to form a useful, coherent, nonwoven fabric. Other nonwoven fabrics are described by Evans in U.S. Pat. No. 3,485,706. They are made by forming a web of fibers and treating it with pressure jets to entangle the fibers and produce a strong fabric comprising two areas of primary tanglelaced fibers joined by secondary fibers or ordered groups of secondary fibers. Evans does not require the addition of binder for the fabrics to be self-supporting and useful for many purposes. It would be desirable to improve on the fabrics of Evans, without having to resort to the addition of a binder of Kalwaites or Griswold.

DESCRIPTION OF THE PRIOR ART

U.S. Pat. No. 3,769,659 of Kalwaites disclosed treating a layer of non-woven fibers, that may comprise cotton with a liquid under pressure by supporting the fibers on a rather special backing means. The backing means contained large areas that were not perforated and foraminous portions occupying only a small area. A patter of different streams of fluid has to be passed through the fabric which could, if desired, have a binder applied to it.

U.S. Pat. No. 3,113,349 of Nottebohm passing a gas from a tube through non-woven fiber webs containing a binder. Nottebohm caused the tube to oscillate backwards and forwards but a binding agent was applied before the treatment.

U.S. Pat. No. 4,152,480 of Adachi was concerned with using a high pressure liquid stream in the form of a film passing through a slit shaped nozzle onto a web of fibers. He reciprocated the liquid jet stream, but found it necessary to use an elongated stream of liquid to rearrange the fibers.

De la Serviere in U.S. Pat. No. 3,802,838 disclosed passing a cotton web through a bath and draining the layers. The layers were unfortunately under the top level of the liquid in the bath during the treatment and not under pressure through jets or nozzles.

Guerin in U.S. Pat. No. 3,214,819 discloses making hydraulically loomed fibrous material using a fluid needle to avoid forming a patterned fabric.

Boulton in U.S. Pat. No. 3,620,903 disclosed the formation of a double lager nonapertured textile fabric.

Balzaro in French Pat. No. 2,265,891 (assigned to Bertin & Cie) disclosed the formation of a non-woven fabric by advancing a fibre lap on a porous support and directing a jet of fluid onto the lap from a jet capable of traversing across the lap.

Bunting et al., in U.S. Pat. Nos. 3,493,462, 3,508,308 and 3,620,903 describe a process for producing lightweight, nonpatterned, nonwoven fabrics, by treating an array of fibers to essentially columnar streams of liquid jetted from orifices under high pressure. The jet streams may be rapidly oscillated, which oscillation is done for the purpose of producing a smooth fabric surface and to enhance the nonpatterned structure of the nonwoven fabric.

In the processes taught by Kalwaites and Griswold, and referred to above, resin binder is added to the rearranged fabric to produce a commercially useful nonwoven fabric. With the Evans process, referred to above although binder need not be added, high pressure water jets are used to produce the nonwoven fabric.

SUMMARY OF THE INVENTION

The present invention is based upon the discovery of a process whereby cotton fibers can be fluid rearranged under particular parameters to produce useful nonwoven fabrics, without the necessity for the use of any resin binder, and yet the fluid rearrangement surprisingly takes place a relatively low pressures. Thus, the process of the invention can be carried out using relatively inexpensive and uncomplicated equipment under specific process conditions.

We have found that, by comparison with the conditions used by Evans, the impact pressure or "momentum" used by him (and as defined in his specification) is about 285 times that used in the present invention. Furthermore, whereas Evans could not produce products using sprays having a momentum flux of 0.11 $kg.m/sec^2/cm^2$ the present invention enables very good products to be produced at that value.

The present invention provides a process for producing a nonwoven fabric which comprises:

(a) supporting a layer comprising at least a major proportion of gray cotton fibers which are free from any artificial binder and which are in contact with each other but which are capable of movement under applied liquid forces, on a liquid pervious support member adapted to move in a predetermined direction and on which fiber movement in directions both in and at an angle to the plane of said layer is permitted in response to applied liquid forces, said liquid pervious member being a foraminous mesh formed of a plurality of first substantially parallel lines of filaments and a plurality of second substantially parallel lines of filaments crossing the first said lines to form fixed crossing positions where the first and second substantially parallel lines cross, the crossing points providing a predetermined pattern of high points with valleys existing between adjacent high points, the said foraminous mesh having a regular pattern of holes therein between the lines of filaments and extending over the whole area thereof, the said holes occupying at least 30% of the area of the pervious member;

(b) moving the liquid pervious supporting member with the supported layer of fibers thereon in said predetermined direction through a fiber rearranging zone within which spaced-apart sprays of liquid from individual jets are projected directly downwardly in a substantially vertical direction at a pressure of from about 700 to about 4,300 Kpa onto said layer from a plurality of nozzles or jets positioned above the layer while oscillating the nozzles or jets in a direction transversely of the said predetermined direction of travel at a frequency of oscillation of from about 60 to about 300 cycles per minutes and at an amplitude of from about 5 to about 100 millimeters, the momentum transferred from the liquid coming from the nozzles or jets onto the fibers being greater than 230 kg meter/sec/meter$^2$;

(c) permitting said sprays of liquid from the nozzles or jets to pass through said layer and said foraminous support member to effect movement of said fibers from over those portions of the support member where there are high points towards the valleys of the support member to form a patterned layer characteristic of the said liquid pervious foraminous support member, and to effect sufficient mechanical engagement of said fibers in the portions over the valleys to product a self-supporting coherent layer without utilizing any artificial binder; and (d) subjecting the self-supporting coherent layer of step (c) to a cotton scouring step to remove natural oils and waxes therefrom, thereby obtaining a coherent fabric having a pattern of a plurality of apertures therein, and a tensile strength which is at least as great for the wet fabric as for the dry fabric when measured in both the directions transverse of and longitudinally of the direction in which the cotton fibres were moved.

The invention also provides a non-woven fabric comprising a coherent web having at least a major proportion of cotton fibres, a pattern of a plurality of apertures therein formed by forcing a fluid under pressure through the web, said fabric being free from a synthetic resin binder, and having a tensile strength, measured in two directions in right angles, which is at least as great for the wet fabric as for the dry fabric. The fabrics have a high absorption capacity for water.

DETAILED DESCRIPTION OF THE INVENTION

Gray cotton fibers, ie natural fibers of cotton from which the oils, waxes, lignin and the like have not been removed, and which have not been chemically treated with a binder or the like chemical substance, are used in the process or the invention. The fibers are in contact with adjacent fibres but are capable of movement in a vertical plane as well as in a horizontal plane.

The fibers are supported on a liquid pervious foraminous support, for example a metal or plastics grid having both high points and low points. The filaments forming the mesh of the grid may be in a standard weave of sinusoidal pattern, or any other desired pattern. The fibers of the mesh may alternatively be nonwoven but can be joined together at certain points where the two parallel lines of fibers cross, eg by welding of the metal or plastics fibers at those points to form high points, and valleys between adjacent high points.

At least 30%, more conveniently at least 40% or over 50% and higher of the area of the pervious member consists of holes between the lines of filaments of the mesh. Examples of meshes which have given particularly good results are those having about 40%, 51% and 50% of holes ie "open area".

The foraminous member moves the web forwards while sprays of a liquid, eg water from the plurality of individual jets are directed downwardly, preferably vertically, onto the layer of fibers.

The pressure of the liquid must be in the region of about 700 to 4,300 kpa from the nozzles or jets. The nozzles or jets are oscillated transversely of the direction of movement of the foraminous support. The frequency of oscillation is from about 60 to 300, more usually about 75 to 200 cycles per minute and the amplitude is from 5 to 100 millimeters. The amount of energy transferred from the sprays of liquid from the nozzles or jets to the fibres is important for obtaining the product of the invention. Measured as momentum, it is at least 230 kg/meter/sec/meter$^2$.

The momentum may conveniently be in the range from 230 to about 2,500 kg/meter/sec/meter$^2$. Very convenient momenta are in the region of 900 to 1,200 kg/meter/sec/meter$^2$.

The sprays of liquid causes the fibers to rearrange themselves in a particular pattern moving down from the high points towards the valleys to form a patterned layer characteristic of the foraminous support member. The fibers, under the particular numerical parameters of the percentage of holes in the member, the pressure of the liquid, the frequency and oscillation and particularly the transfer of energy enable a very desirable self-supporting coherent layer to be obtained. The layer does not contain any artificial binder but is held together by mechanical engagement of fibers which have moved into the valleys.

The nozzles or jets, unexpectedly, can be as far apart as 0.8 mm or even further apart.

Thereafter the coherent layer is subjected to a cotton scouring step to remove natural oils and waxes therefrom. The cotton scouring step may involve bleaching of the fibers. The coherent fabric obtained has a pattern of a plurality of apertures therein. Their tensile strength in both the longitudinal direction and in the lateral direction of the fabric is as great, or usually greater, for the wet fabric compared with the dry fabric.

With the invention the array of gray cotton fibers are subjected to a series of sprays or jets of a liquid such as water, wherein the water sprays or jets are mounted under low frequency oscillation. The cotton fibers are rearranged by the water to form a coherent web of patterned gray cotton fibers. As stated above this coherent web, preferably without drying, is then treated to conventional cotton scouring, eg bleaching techniques, and is then dried, to produce a strong, coherent highly absorbent cotton nonwoven fabric.

The invention and apparatus for its manufacture are illustrated in the accompanying drawings.

DETAILED DESCRIPTION OF THE INVENTION

Figure 1:
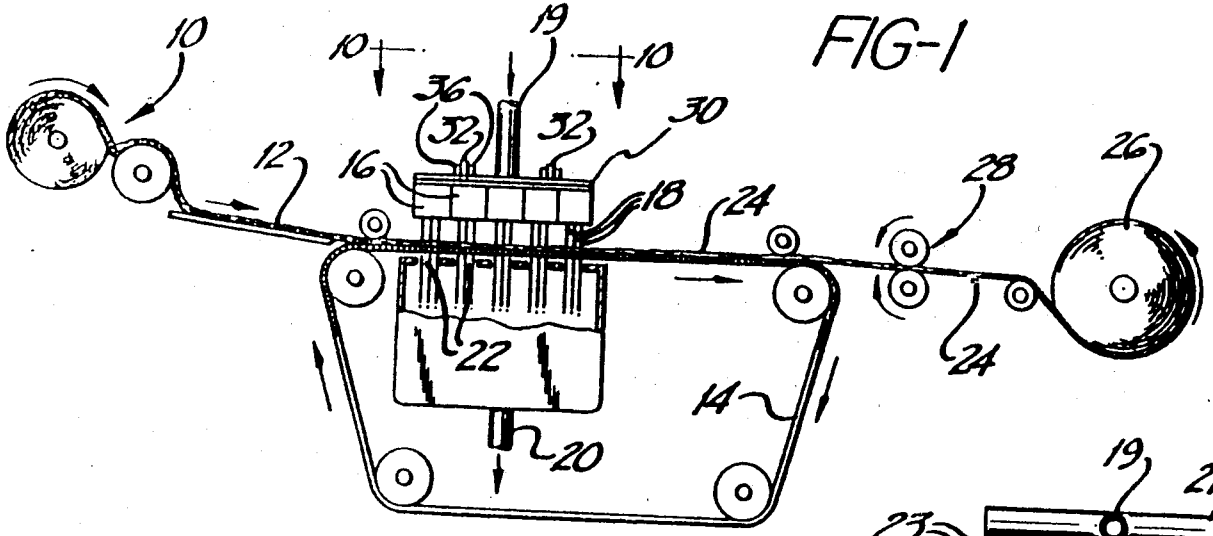
FIG. 1 is a schematic view in elevation of an arrangement of apparatus suitable for carrying out the process of the invention.
Figure 10:
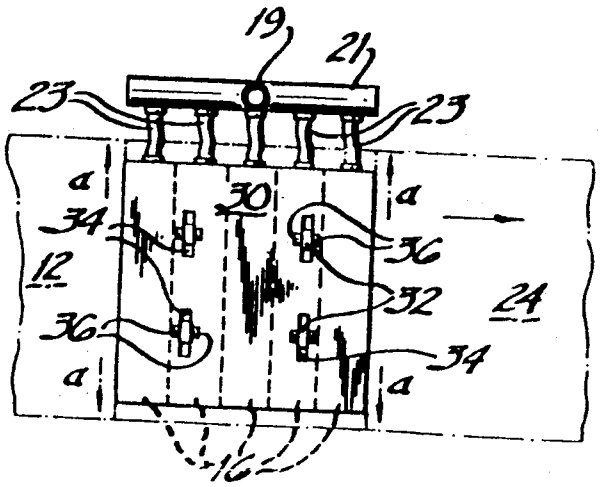
FIG. 10 is a top plan view of the manifold section looking in the direction of the arrows 10—10 of FIG. 1.

Referring to FIGS. 1 and 10, a carded web 12 of gray cotton fibers, which is free from artificial binder, is produced by a card 10, and is then passed onto a liquid pervious support member or forming belt, such as an endless woven belt 14. The belt 14 is a foraminous member which is made from a weft and weave of sets of parallel metal filaments at right angles to each other. Each filaments forms a sinusoidal curve with cross filaments being positioned in the valleys and under the high points in a standard grid pattern. The area of the holes in the grid was about 51%. The belt 14 carries the web 12 of fibers under a series of manifolds 16 that are arranged in rows disposed transversely across the path of travel of the belt 14 (ie they are disposed in the cross direction). On the manifolds 16 are mounted spray heads or orifice strips for ejecting liquid 18 in jets under moderate pressure down onto the carded web 12 of cotton fibers supported on the belt 14. The liquid is provided from a source (not shown) of pressurized water, through a main water duct 18, to a common supply manifold 21, and through flexible hoses 23 into each manifold 16. The manifolds 16 are constructed and adapted so that they can be oscillated transversely to the path of travel of the web 12 (see the arrows "a" in FIG. 10, which show the direction of oscillation), with the frequency of oscillation being, for instance, from about 1 to about 5 oscillations per second. There may be a vacuum duct 20 attached to conventional vacuum means (not shown) pulling a vacuum of, for example, up to 5 to 10 inches of mercury beneath the belt 14, with vacuum slots 22 being positioned directly under each manifold 16. The cotton fibers in the web 12 are rearranged by the liquid jets or spray 18 as the liquid impinges upon and passes through the fibrous web 12 and then through the belt 14. The rearranged fibrous web 24 can be de-watered, as by passing it through a pair of squeeze rolls 28, and it is then carried to a conventional windup 26, still in the wet state, for subsequent bleaching. The rearranged fibrous web 24 is preferably kept wet until it has been bleached, in order to impart sufficient strength to the web 24 so that it can be handled. The rearranged fibrous web is then bleached by conventional cotton bleaching procedures, and is then rinsed and dried, to produce the cotton patterned nonwoven fabric of the invention.

The process of the invention is employed with gray cotton staple fibers. While other fibers can be blended with the cotton, the gray cotton must comprise at least a major proportion of the web to be employed in the process of the invention. As used herein, "gray cotton" refers to cotton that has not been bleached or scoured.

The cotton feed web can be formed by carding, airlaying, or other conventional web-forming procedure. Typical feed web weights are from about 25 to about 200 grams per square meter.

If desired, a reinforcing web such as a scrim or a reticulated plastic netting can be used. Typically, the carded cotton fiber feed web is laid down on top of the reinforcing web prior to the liquid rearranging.

The liquid pervious support member or forming belt that is employed to carry the array of cotton fibers under the water spray can be conventional plain weave belt woven of polyester monofilament, bronze, or other conventional materials. The belts will usually have from 35 to 75 percent open area. Such belts are conventionally made from monofilaments having a filament count of from about 11 to about 236 filaments per 120 centimeters (about 3 to 60 filaments per inch) in both directions.

The water that is jetted or sprayed onto the fibers can be provided at relatively low pressure, for instance, from about 100 to about 600 psi (that is, from about 700 to about 4,300 kpa). The water spray can be provided in the form of essentially columnar jets, if desired, but can also be employed in the form of sprays with a relatively wide angle of divergence, for instance, up to about 10 degrees.

The exact number of spray heads per unit width has not been found to be narrowly critical. However, a much wider spacing can be used then is customarily employed with the technique of Evans (U.S. Pat. No. 3,485,706). When using columnar jets having diameters of from about 3 to 10 mils, the usual spacing is from about 2 to about 10 jets per inch (ie per 25 millimeters). When using spray jets instead of columnar jets, above one-half to two per inch (ie per 25 millimeters) are typical. (Closer spacing would be difficult because of the size of the spray heads.) The columnar jets are therefore from 2.5 to 12.5 mm apart, whereas spray jets would be 12.5 to 50 mm apart.

The number of rows of jets (ie, the number of jets in the machine direction or direction of travel of the forming belt) has not been found to be narrowly critical. Typically, there will be from about 10 to about 30 rows when spray jets are used, and from about 8 to about 20 rows when columnar jets are used.

For the conditions indicated above (ie, typical web weights, jet liquid pressures, jet spacings, and rows of jets), the usual speed of the forming belt is from about 5 to about 20 meters per minute.

A major point of novelty of this invention is the provision of means to impart transverse oscillation to the jets. Such oscillation can be effected by mounting the manifolds 16 in such a way that they are transversely moveable (as by using roller bearings or linear bearings), and employing a driven crank-shaft, rotating cams, eccentrically mounted rotating circular disks, or other conventional oscillation-imparting means (not shown), to engage the manifolds and oscillate them. The manifolds can be oscillated either together (in phase with each other) or independently (out of phase with each other).

In the embodiment schematically shown in the drawings, the manifolds 16 are ganged, and are suspended from a stationary mounting plate 30. Upstanding projections or lugs 32 attached to the ganged manifolds 16 extend through slots 34 in the stationary mounting plate 30. Roller bearings 36 mounted on the lugs 32 ride on the mounting plate 30 as the ganged manifolds 16 oscillate.

The oscillation used is a relatively low frequency oscillation, eg., from about 75 to about 200 cycles per minute. The amplitude of the oscillation is not narrowly critical, and it can vary, for instance, from about 5 millimeters to about 50 millimeters.

The rearranged web is subjected to a conventional cotton bleaching process (which is illustrated below in the examples), and is then dried as by passing it over a set of steam cans.

The examples below illustrate the practice of the invention.

EXAMPLE 1

A carded web of gray cotton having a weight of 50 grams per square meter was laid down onto a single layer of woven cotton gauze. The gauze was a plan weave scrim having a warp thread count of 17 per inch and a weft thread count of 13 per inch, and weighed 15 grams per square meter. The double layer web was then passed onto a woven belt having the following description:

The belt was a plain weave belt having about 51% of holes in it and woven of polyester monofilaments. The warp and weft threads had diameter of 500 microns, and the thread counts were 40 warp threads per centimeter and 10 weft threads per centimeter.

The belt carrying the web of carded cotton plus scrim was passed under a series of manifolds at a speed of 10 meters per minute. The manifolds contained spray nozzle that were 55 millimeters apart (center-to-center) in the cross direction, and there were 8 rows of nozzles in the machine direction. The spray nozzles used were designed to deliver solid streams of water through orifices having diameters of about 8 mils.

The belt was 15 millimeters under the tips of the nozzles. Water was sprayed through the nozzle at a pressure of 3,500 kpa. As the web was carried under the nozzles, the manifolds in which the nozzles were mounted were vibrated at a frequency of 120 cycles per minute and an amplitude of 37 millimeters. Vacuum slots under the belt below each row of nozzles pulled a vacuum of about 5 inches of mercury. The fabric was passed through the apparatus 10 times.

The momentum transferred from the liquid onto the fibres was 909 kg meter/sec/meter$^2$. The web was dewatered by passing it through a pair of squeeze rolls, was collected on a windup while still wet, and was then bleached under the following conditions.

The fabric is rolled onto a perforated spindle and is then placed in a bleaching kier. The fabric is wet out with hot water and then drained. The kier is then filled (to a level above the cloth) with an aqueous solution containing caustic soda, soda ash, and soap, and allowed to circulate. Hydrogen peroxide is added and the kier is sealed and heated to 120° C., where it is kept for 20 minutes. The kier is then cooled, drained, and rinsed twice with cold water. Dilute acetic acid is added to a pH of 6.5–7.0 and then two more rinses are made. If the pH of the final rinse if 6.5–7.0, the cloth is removed and dried. The absorption capacity of the fabric for water was high.

Figure 2:
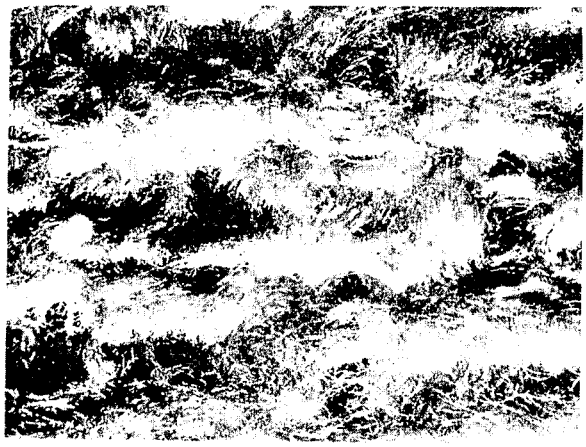
FIGS. 2 through 5 are photomacrographs, originally taken at 10×, of the nonwoven fabric of Example 1 of this application.
Figure 3:
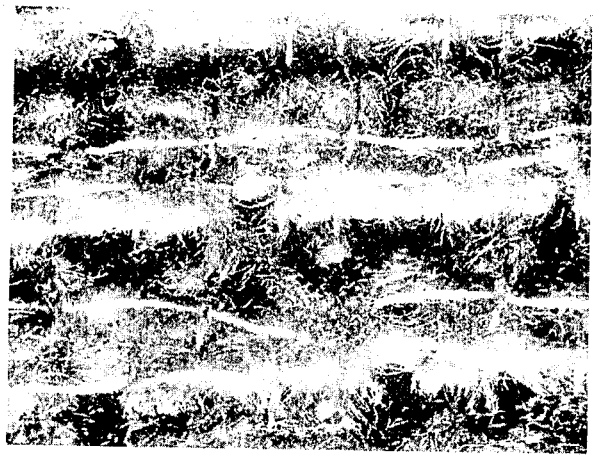
Figure 4:
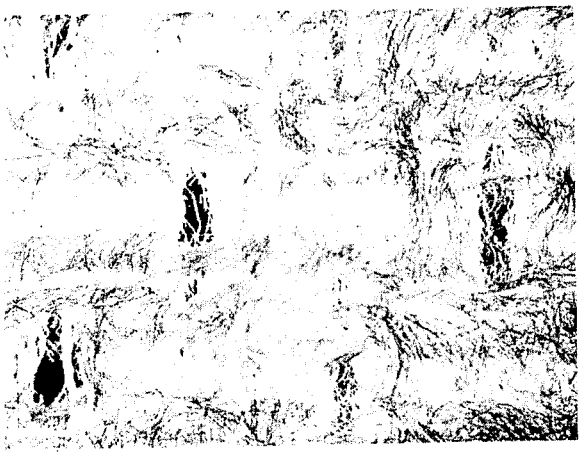
Figure 5:
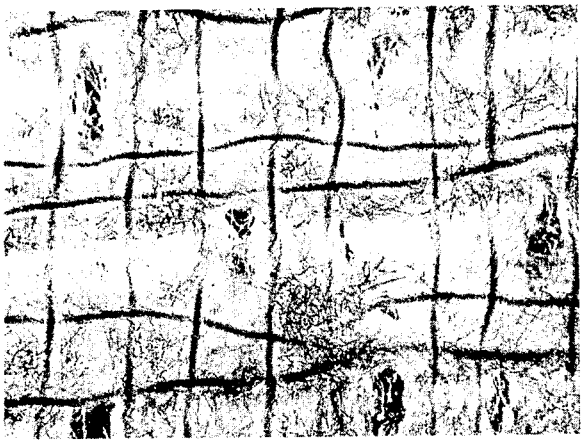
Figure 6:
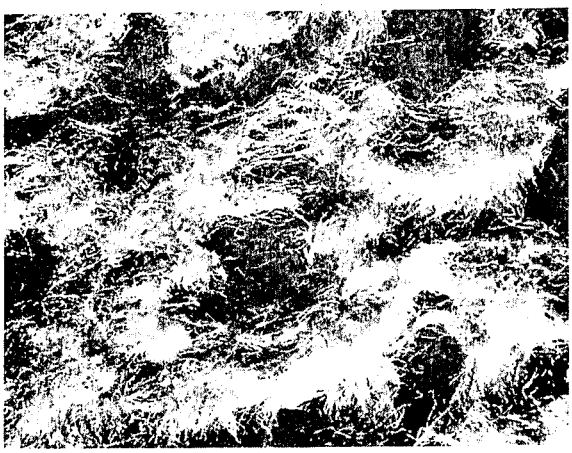
FIGS. 6 through 9 are photomacrographs, originally taken at 10×, of the nonwoven fabric of Example 2 of this application.
Figure 7:
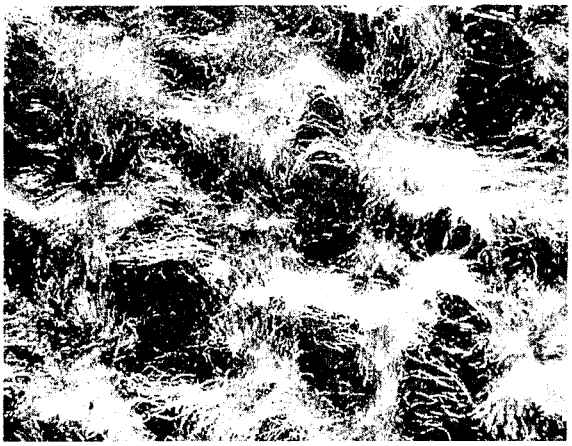
Figure 8:
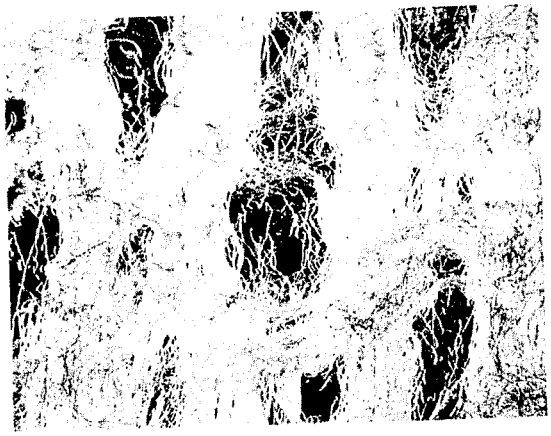
Figure 9:
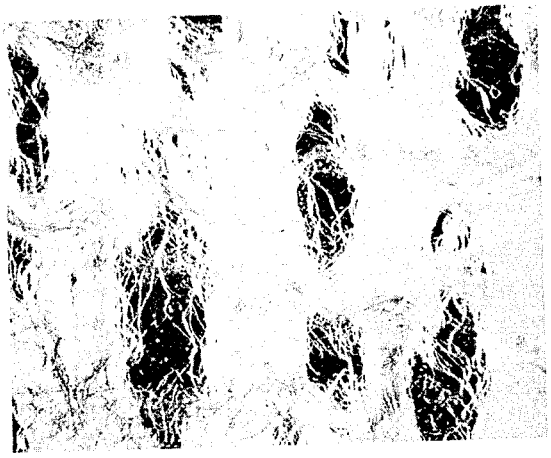

Photomacrographs of this fabric are shown in FIGS. 2–5. FIGS. 2 and 3 were made with incident light and FIGS. 4 and 5 were made with transmitted light. FIGS. 2 and 4 show the top side of the fabric and FIGS. 3 and 5 show the bottom or belt side (ie the side that was next to the belt during the rearranging).

EXAMPLE 2

By a procedure analogous to that described in Example 1, a cotton patterned fabric was made from a web or carded gray cotton having a basis weight of 50 grams per square meter. The forming belt was the same as that described in Example 1. The processing conditions were as follows:

Belt speed—10 meters per minute
Spray pressure 3500 kpa
Manifold Oscillation
  2 cycles per second
  3.7 centimeter amplitude
  Momentum transferred 909 kg meter/sec/meter$^2$ The wet, rearranged fabric was bleached and dried by a procedure analogous to that of Example 1. Photomacrographs of the fabric are shown in FIGS. 6–9. As with Example 1, the photomacrographs were taken both with incident light and with transmitted light, and both the top and belt sides are shown. Its absorption capacity for water was high.

The fabrics described in this application are useful as bandages, sponges, swabs, primary dressings, secondary dressings, prepping swabs, and other absorbent products.

EXAMPLES 3 AND 4

By a procedure analogous to that described in Example 1, a gauze reinforced fabric was made from a web of grap cotton having a weight of 50 grams per square meter and the scrim described in Example 1. Instead of using spray nozzles, the water was jetted through the holes in an orifice strip, the holes being designed to produce essentially columnar jets. The holes had diameters of 0.007 inch, and there were four holes per inch. There were 12 rows of nozzles. Only one pass through the apparatus was used. The processing conditions were the following:

Belt speed—10 meters per minute
Jet pressure—3,500 kpa
Manifold oscillation
  2.67 per second
  3.1 centimeter amplitued
Momentum transferred—1,182 kg meter/sec/meter$^2$ The webs were dewatered, bleached, and dried as described in Example 1. Their absorption capacities for water were high.

The procedure was repeated, but without using the gauze reinforcement. Typical tensile properties of both the gauze-reinforced and the non-reinforced fabrics are the following:

| | Tensile Strengths | |
|---|---|---|
| | Non-Reinforced | Gauze-Reinforced |
| (a) MD Dry | 13.7 Newtons, minimum | 27,5 and 19,6 N, min |
| (b) MD Wet | 15,7 N min | 27,5 N min |
| (c) CD Dry | 4,7 N min | 10,3 and 8,3 N min |
| (d) CD Wet | 4,9 N min | 12,7 N min |

wherein MD represents machine direction (ie the direction of travel of the web) and CD represents cross-direction (ie the direction transversely of the direction of travel of the web).

The tensile tests were carried out on an Instron tensile tester. Sample size was 25×130 mm. The initial distance between the jaws as 100 mm. The crosshead speed was set at 200 mm/minute.

As can be seen, for the non-reinforced fabric, the tensile strength for the wet fibre was greater both longitudinally (15.7 against 13.7) and transversely of (4.9 against 4.7) than for the dry fabric. For the gauze-reinforced fabric, the tensile strength was the greater or the same (27.5 compared with 27.5 or 19.6) longitudinally and greater transversely (12.7 compared with 10.3 or 8.3) for the wet fabric compared to the dry fabric.

With the gauze-reinforced samples, there are two peaks in the stress/strain curve. The higher numbers are the tensile stengths of the gauze reinforcement; the lower are the tensile strengths of the entangled cotton.

Thus, in the case of the gauze reinforced fabric, if only the entangled cotton is compared, the strength of the entangled cotton in both the longitudinal direction (27.5 against 19.6) and in the transverse direction (12.7 against 8.3) is higher for the wet cotton than for the dry cotton.

We claim:

1. Process for producing a nonwoven fabric which comprises:

(a) supporting a layer comprising at least a major proportion of gray cotton fibers which are free from any artificial binder and which are in contact with each other but which are capable of movement under applied liquid forces, on a liquid pervious support member adapted to move in a predetermined direction and on which fiber movement in directions both in and at an angle to the plane of said layer is permitted in response to applied liquid forces, said liquid pervious member being a foraminous mesh formed of a plurality of first substantially parallel lines of filaments and a plurality of second substantially parallel lines of filaments crossing the first said lines to form fixed crossing positions where the first and second substantially parallel lines cross, the crossing points providing a predetermined pattern of high points with valleys existing between adjacent high points, the said foraminous mesh having a regular pattern of holes therein between the lines of filaments and extending over the whole area thereof, the said holes occupying at least 30% of the area of the pervious member;

(b) moving the liquid pervious supporting member with the supported layer of fibers thereon in said predetermined direction through a fiber rearranging zone within which spaced-apart sprays of liquid from individual jets are projected directly downwardly in a substantially vertical direction at a pressure of from about 700 to about 4,300 kpa onto said layer from a plurality of nozzles or jets positioned above the layer while oscillating the nozzles or jets in a direction transversely of the said predetermined direction of travel at a frequency of oscillation of from about 60 to about 300 cycles per minute and at an amplitude of from about 5 to about 100 millimeters the momentum transferred from the liquid coming from the nozzles or jets onto the fibers being greater than 230 kg meters/sec/meters$^2$;

(c) permitting said sprays of liquid from the nozzles or jets to pass through said layer and said foraminous support member to effect movement of said fibers from over those portions of the support member where there are high points towards the valleys of the support members to form a patterned layer characteristic of the said liquid pervious foraminous support member, and to effect sufficient mechanical engagement of said fibers in the portions over the valleys to produce a self-supporting coherent layer without utilising any artificial binder; and (d) subjecting the self-supporting coherent layer of step (c) to a cotton scouring step to remove natural oils and waxes therefrom, thereby obtaining a coherent fabric having a pattern of a plurality of apertures therein, and a tensile strength which is at least as great for the wet fabric as for the dry fabric when measured in both the directions transverse of and longitudinally of the direction in which the cotton fibres were moved.

2. A process according to claim 1, wherein the nozzles or jets are spaced at least 0.8 millimeters apart, center to center.

3. A non-woven fabric comprising a coherent web having at least a major proportion of cotton fibers and made by the process of claims 1 or 2.

* * * * *

UNITED STATES PATENT AND TRADEMARK OFFICE

CERTIFICATE OF CORRECTION

PATENT NO. : 4,647,490

DATED : March 3, 1987

INVENTOR(S) : Alan S. Bailey and Colin F. Clayson

It is certified that error appears in the above-identified patent and that said Letters Patent is hereby corrected as shown below:

On the cover page, in the Related U.S. Application Data section, it should read as follows:

--Continuation-in-part of Ser. No. 496,774, May 20, 1983, abandoned.--

In Column 1, line 7, "496,776" should be --496,774--.

Signed and Sealed this

Twenty-third Day of August, 1988

*Attest:*

DONALD J. QUIGG

*Attesting Officer*

*Commissioner of Patents and Trademarks*